US005185629A

United States Patent [19]

Iino et al.

[11] Patent Number: 5,185,629

[45] Date of Patent: Feb. 9, 1993

[54] IMAGE FORMING APPARATUS PROVIDED WITH A COOLING ARRANGEMENT AND OZONE FILTER

[75] Inventors: Shuji Iino, Hirakata; Kenji Masaki, Ibaraki, both of Japan

[73] Assignee: Minolta Camera Kabushiki Kaisha, Osaka, Japan

[21] Appl. No.: 600,835

[22] Filed: Oct. 22, 1990

[30] Foreign Application Priority Data

Oct. 23, 1989 [JP] Japan ..... 1-276769

[51] Int. Cl.[5] ..... G03G 15/00; G03G 21/00

[52] U.S. Cl. ..... 355/215; 355/30

[58] Field of Search ..... 355/200, 215, 30, 219, 355/221, 285

[56] References Cited

U.S. PATENT DOCUMENTS

| | | | |
|---|---|---|---|
| 4,093,368 | 6/1978 | Nishikawa | 355/215 X |
| 4,202,618 | 5/1980 | Waschk et al. | 355/215 X |
| 4,264,184 | 4/1981 | Nishikawa et al. | 355/210 |
| 4,853,735 | 8/1989 | Kodama et al. | 355/215 |

FOREIGN PATENT DOCUMENTS

| | | | |
|---|---|---|---|
| 55-155369 | 12/1980 | Japan | 355/221 |
| 57-17957 | 1/1982 | Japan | 355/215 |
| 60-213968 | 10/1985 | Japan | 355/215 |
| 61-201262 | 9/1986 | Japan . | |
| 63-159873 | 7/1988 | Japan . | |
| 63-165878 | 7/1988 | Japan . | |

*Primary Examiner*—Joan H. Pendegrass
*Attorney, Agent, or Firm*—Burns, Doane, Swecker & Mathis

[57] ABSTRACT

The image forming apparatus includes a housing, image forming device provided in the housing for forming a toner image onto a sheet, and a fixing device provided in the housing for heating the toner image to be fixed on the sheet. A passageway is provided adjacent to the fixing device for intaking air substantially directly from the exterior of the housing and exhausting out to the exterior so as to form a cooling passageway. An airflow controller is provided for causing said air flow to form the cooling passageway.

6 Claims, 7 Drawing Sheets

IMAGE FORMING APPARATUS PROVIDED WITH A COOLING ARRANGEMENT AND OZONE FILTER

BACKGROUND OF THE INVENTION

1. Field of the Invention

The present invention relates to an image forming apparatus such as a copier or a printer, and more particularly to a technique of cooling heat sources inside the image forming apparatus.

2. Description of the Prior Art

With a copier or other image forming apparatus, an exposure lamp of an exposure device for exposing a surface of a photosensitive material, and fixing rollers for fixing a toner image to recording paper may become heated to a degree to adversely affect other components. Therefore, air is drawn into the main body of the apparatus from outside to cool the exposure lamp and fixing rollers, and the air having been used for the cooling purpose is exhausted from the main body.

On the other hand, in the image forming apparatus as noted above, ozone is generated by electric discharges from a main charger for charging the surface of the photosensitive material and from a transfer and separating charger for transferring the toner image from the surface of the photosensitive material to the recording paper. Further, toner particles, paper particles, oil mist and other such dust are scattered in the regions of a developing device and a cleaning device, for example. Thus, harmful substances such as ozone and dust are afloat inside the apparatus.

When the air used in cooling the exposure lamp and fixing rollers is exhausted from the apparatus, the ozone, dust and other harmful substances afloat in the apparatus will be discharged with the air outwardly of the apparatus. This gives rise to the problem of polluting the environment adjacent the apparatus.

More particularly, very high temperatures prevail in the vicinity of the fixing rollers or a flash fixing device for fixing the toner image by heating and in the vicinity of an optical system for scanning a document image with a halogen lamp or the like. In order to cool these components it is necessary to draw large quantities of air into the apparatus and discharge the air outwardly thereof. This results in a secondary problem in that the harmful substances such as ozone and dust inside the apparatus are inevitably discharged with the cooling air.

Such harmful substances will be generated in the apparatus even if harmful substance removing filters are provided where the harmful substances are generated as noted above, since the filters have limited capabilities and their capabilities deteriorate with lapse of time. Such harmful substances are readily exhausted from the apparatus by a cooling mechanism that produces ample air flows.

In the conventional apparatus as noted above, no concept has been employed for separating air flows of the cooling system and those for removing ozone and other harmful substances. Thus, it has been impossible to sufficiently reduce the chances of the harmful substances flowing out of the apparatus.

SUMMARY OF THE INVENTION

An object of the present invention is to improve cooling air flows for cooling the heat sources inside the image forming apparatus, in order to prevent the harmful substances generated in the apparatus from flowing out of the apparatus as entrained on the cooling air flows.

In order to fulfill the above object, the present invention provides independent ducts in the apparatus for allowing passage of cooling air, thereby to isolate the cooling air from harmful substances in the apparatus.

Working and characterizing features of the present invention will be apparent from the following description of a preferred embodiment to be had with reference to the drawings.

DESCRIPTION OF THE PREFERRED EMBODIMENT

An embodiment of the present invention will particularly be described with reference to the accompanying drawings.

Figure 1:
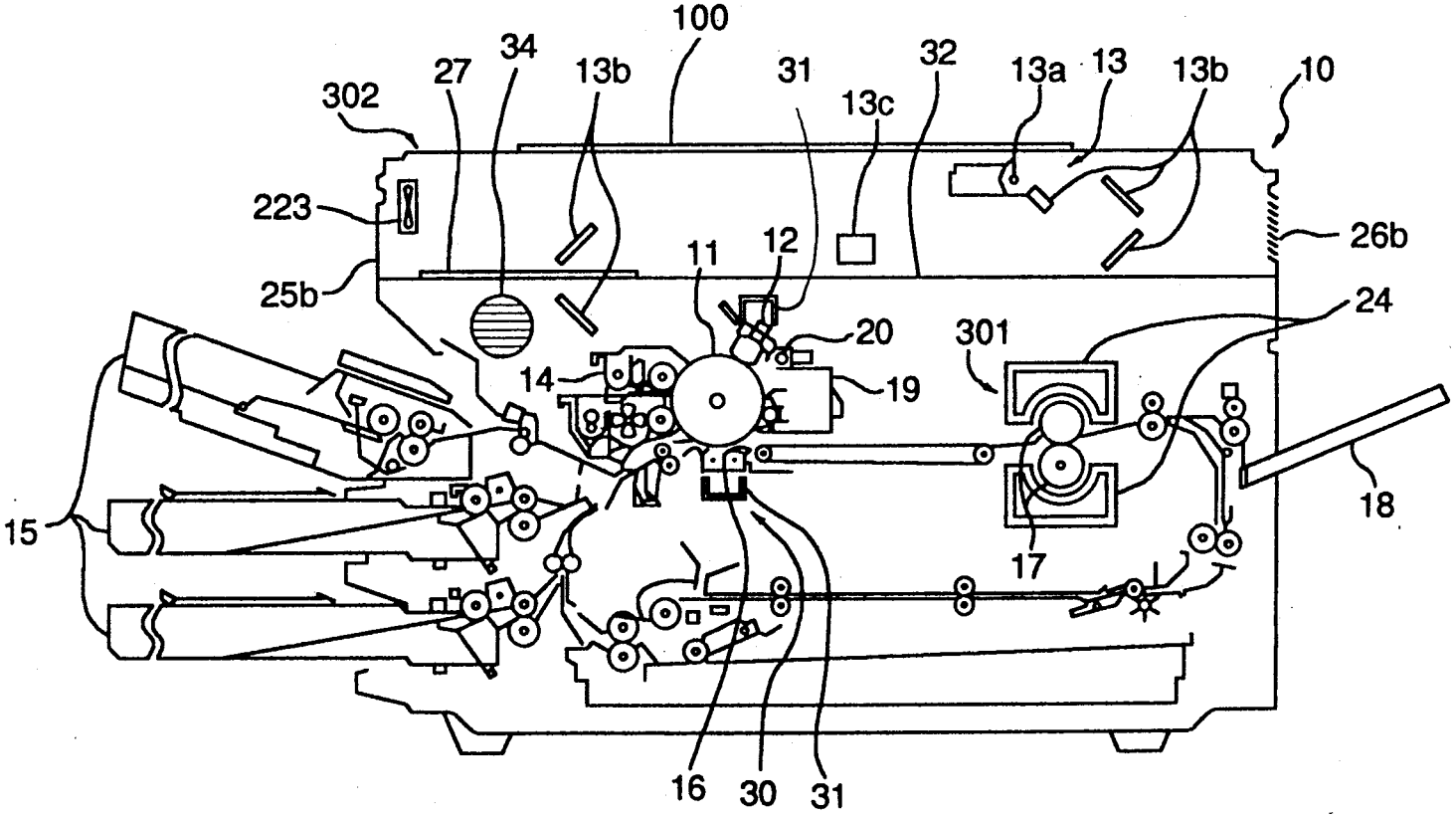
FIG. 1 is a schematic sectional view of an image forming apparatus according to the present invention.
Figure 2A:
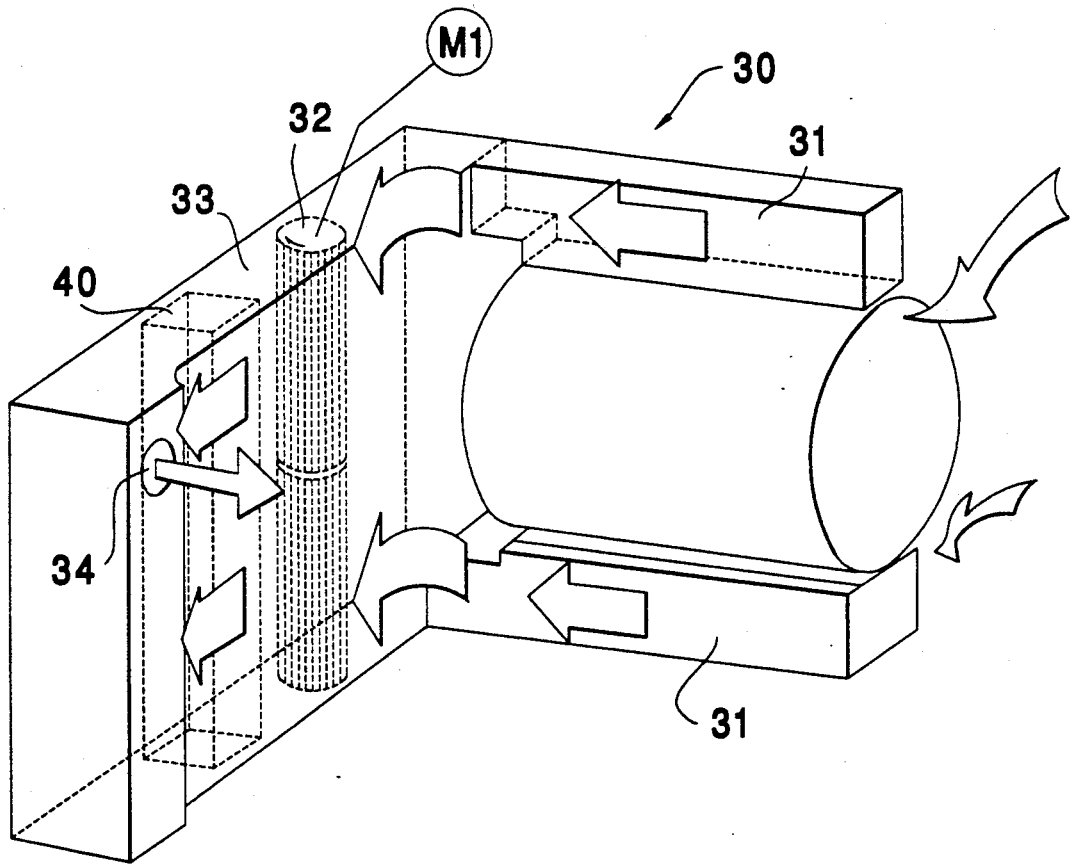
FIGS. 2A through 2D are a perspective view, a schematic front view, a schematic plan view and a schematic side view, respectively, of a circulating device mounted in the image forming apparatus.
Figure 2B:
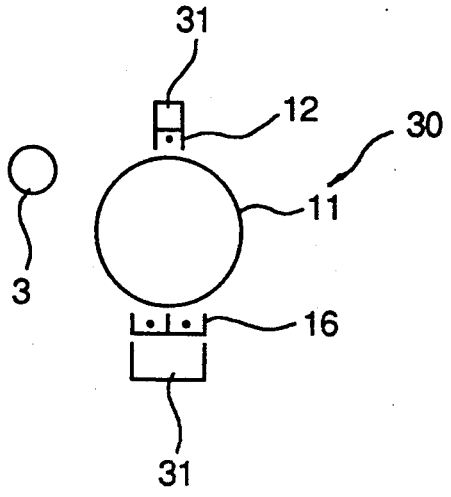
Figure 2C:
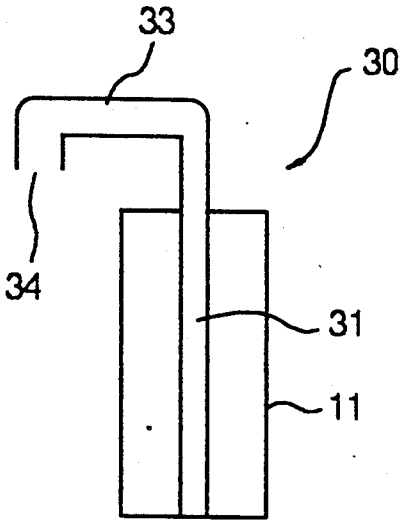
Figure 2D:
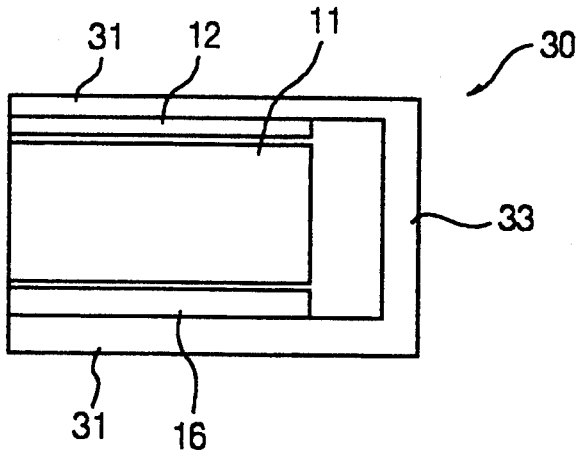

In this embodiment, a copier as shown in FIG. 1 will be described which is one example of an image forming apparatus utilizing an electrophotographic process.

As illustrated, the apparatus has a housing 10 containing a rotatable photoreceptor 11. The surface of the photoreceptor 11 in rotation is charged by a main charger 12. An exposure device 13 including an exposure lamp 13*a*, mirrors 13*b* and a lens 13*c* exposes the charged surface of the photoreceptor 11 to a document image through a platen glass 100 for supporting a document. As a result, an electrostatic latent image is formed on the surface of the photoreceptor 11.

Subsequently, toner is supplied from a developing device 14 to the surface of the photoreceptor 11 carrying the electrostatic latent image, thereby forming a toner image on the surface of the photoreceptor 11. The toner image formed on the surface of the photoreceptor 11 is transferred by a transfer and separating charger 16 onto recording paper (not shown) introduced from a paper supply cassette 15. The toner image thus transferred is fixed to the recording paper by heated fixing rollers 17. Thereafter the recording paper is discharged onto a discharged tray 18. The toner remaining on the surface of the photoreceptor 11 after the image transfer to the recording paper is removed from the photoreceptor 11 by a cleaning device 19. Then the electric charge is eliminated from the surface of the photoreceptor 11 by an eraser lamp 20.

In this embodiment also, ozone is generated when the surface of the photoreceptor 11 is charged by the main charger 12 and when the toner image is transferred to the recording paper by the transfer and separating charger 16. Further, dust is generated with the toner scattered in the regions of the developing device and cleaning device, paper particles scattered in a paper feeding region, and oil mist or the like flying from a mechanical drive for the fixing rollers 17.

The harmful substances such as ozone and dust generated in the housing 10 are drawn and circulated in the housing 10 by an internal circulating device 30, which is depicted in detail in FIGS. 2A through 2D. In addition, the harmful substances are removed by a harmful substance removing device 40 disposed at an appropriate position of the internal circulating device 30.

As shown in FIGS. 1 and 2A through 2D, this embodiment includes ducts 31 disposed adjacent the main charger 12 and transfer and separating charger 16, respectively, for allowing the internal circulating device 30 to draw the harmful substances such as ozone and dust generated in the housing 10 and to circulate the harmful substances inside the housing 10. A circulating fan 32 and a motor M1 for rotating the fan 32 are disposed rearwardly of each duct 31. The circulating fans 32 act to draw into the ducts 31 the ozone generated by the respective chargers 12 and 16 and the dust and other harmful substances afloat in the housing 10.

The air drawn into the ducts 31 and containing the harmful substances is led into a circulating passage 33, through which the air is caused to flow and out through a discharge opening 34 communicating with the interior of the housing 10. Thus, the air containing the harmful substances is not allowed to flow outwardly of the housing 10.

In this embodiment, a harmful substance removing filter is used as the harmful substance removing device 40 for removing the harmful substances such as ozone and dust generated in the housing 10. This filter 40 comprises paper mixed with activated carbon and formed into a honeycomb which includes 100 cells per one inch square.

In the embodiment shown in FIG. 1, this harmful substance removing filter 40 is mounted in the circulating passage 33. Thus, the harmful substances such as ozone and dust drawn by the circulating fan into the ducts 31 are removed by the filter 40.

Consequently, the air caused by the circulating fan 32 to flow through the circulating passage 33 and out of the discharge opening 34 into the interior of the housing 10 contains none or very little harmful substances such as ozone and dust.

The position of the filter 40 for removing the harmful substances is not limited. The filter 40 may be disposed in the circulating passage 33 for circulating the air discharged from the circulating fan 32, or may be disposed in each of the ducts 31. A plurality of such filters may be arranged in the circulating passage 33. Further, separate filters may be provided, one of which is for absorbing ozone and the other for collecting dust only. The filter or filters may be arranged to be removable from the internal circulating device 30.

Figure 3A:
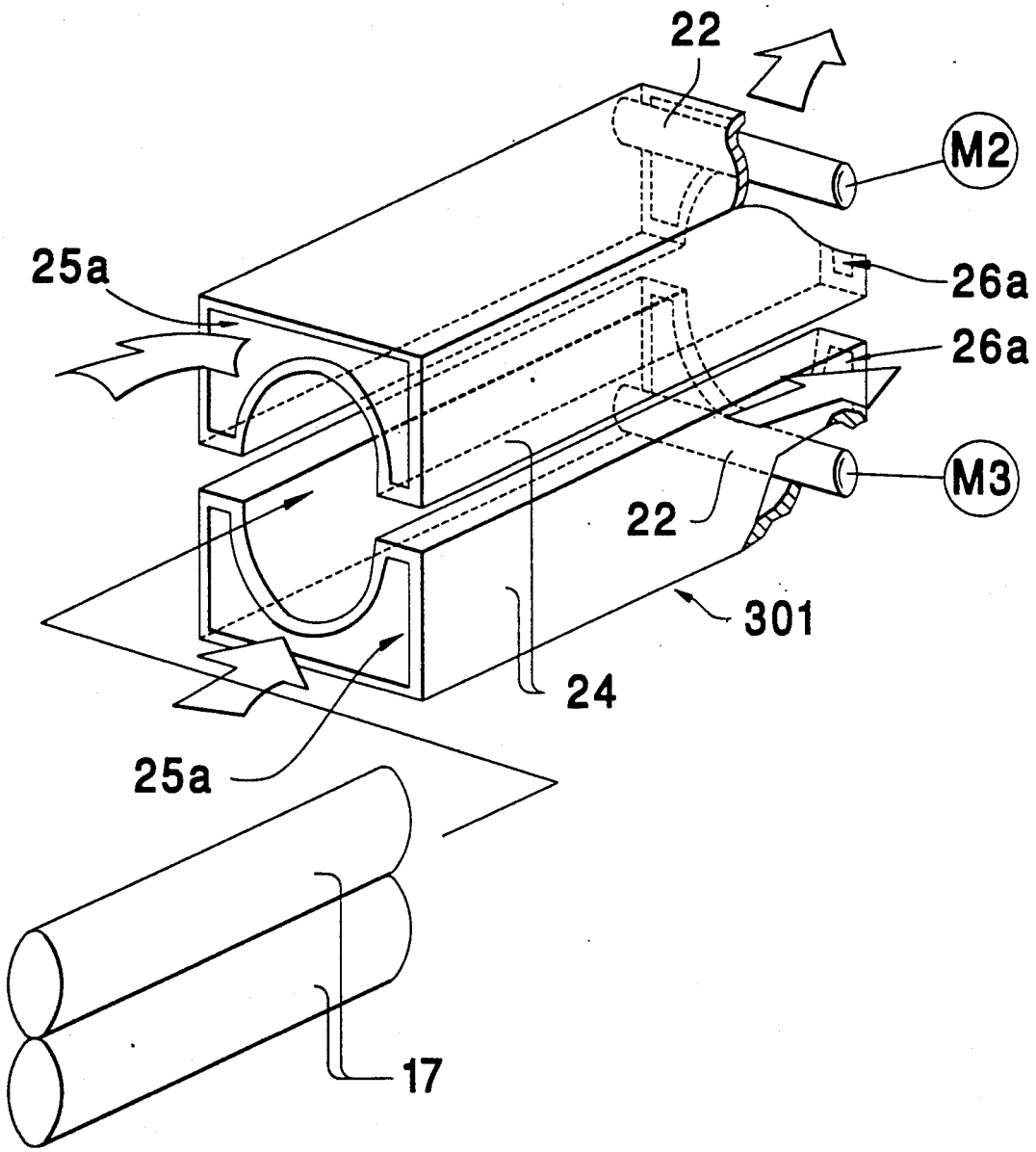
FIGS. 3A and 3B are a perspective view and a schematic plan view, respectively, of a fixing roller cooling device mounted in the image forming apparatus.
Figure 3B:
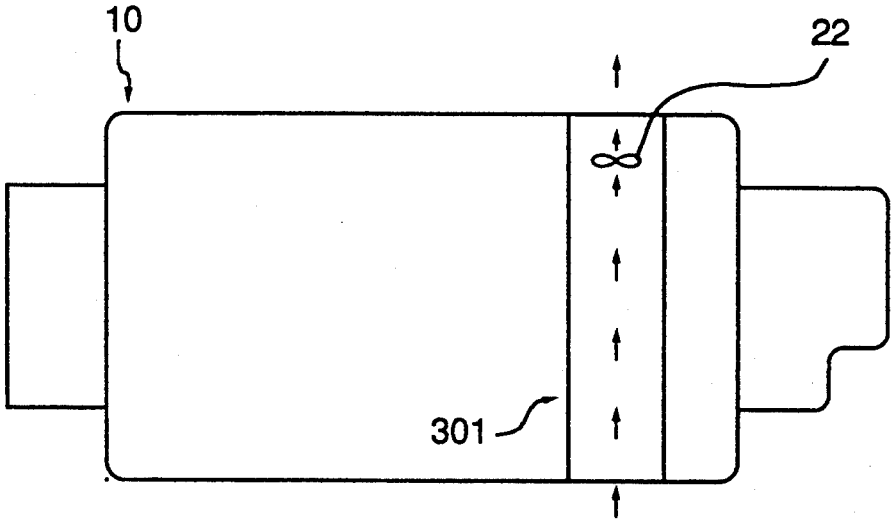

As shown in FIGS. 1, and 3B, this embodiment further comprises a fixing roller cooling device 301 including cooling ducts 24 surrounding and extending axially of the fixing rollers 17 arranged one above the other. This cooling device 301 prevents the air circulated inside the housing 10 by the internal circulating device 30 from mixing with the air used for cooling the fixing rollers 17 and flowing out of the housing 10.

Ambient air is drawn into the respective cooling ducts 24 through suction openings **25*a* defined in the exterior surface of the housing 10 by fans 22 driven by motors M2 and M3. The air thus drawn cools the fixing rollers 17 while flowing through the cooling ducts 24. Thereafter the air is exhausted through discharge openings 26*a* defined in the exterior surface of the housing 10**.

Figure 4:
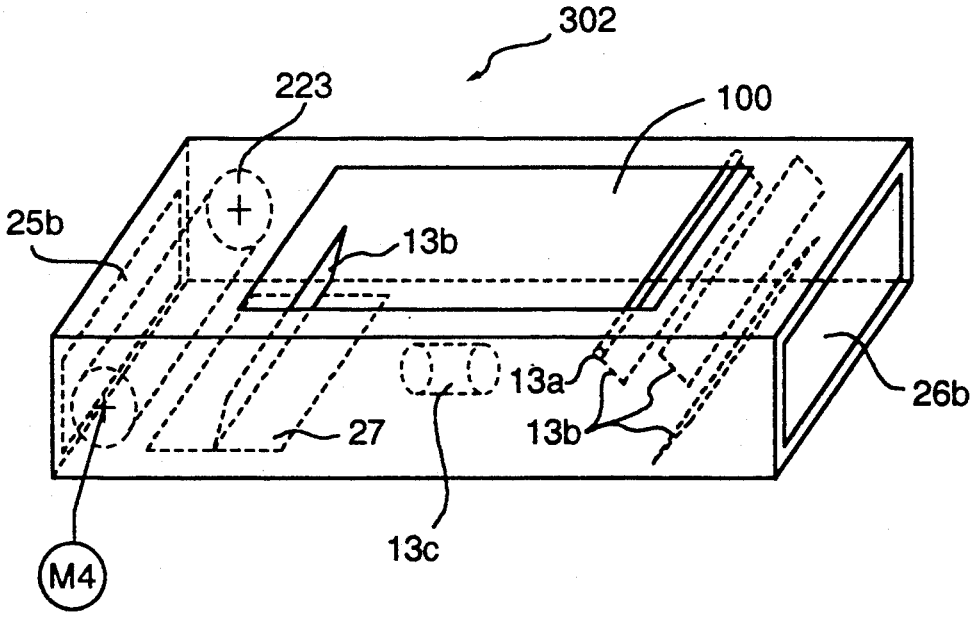
FIG. 4 is a perspective view of an optical system cooling device.

In addition, this embodiment comprises an optical system cooling device 302 for preventing the air circulated inside the housing 10 by the internal circulating device 30 from mixing with the air used for cooling the exposure lamp **13*a* and flowing out of the housing 10. As shown in FIGS. 1 and 4, a transparent separating glass plate 27 is provided between an upper portion of the housing 10 accommodating the exposure lamp 13*a* and the discharge opening 34 for discharging the air for circulation inside the housing 10**.

The upper portion of the housing 10 defines a suction opening **25*b* through which ambient air is drawn by a fan 22 into the upper portion of the housing 10 accommodating the exposure lamp 13*a*. The air thus drawn is guided to the exposure lamp 13*a*, with the separating glass plate 27 preventing the air from mixing with the air discharged through the discharge opening 34. After cooling the exposure lamp 13*a* and adjacent components, the air is exhausted through a discharge opening 26*b* defined in the upper portion of the housing 10**.

Figure 5:
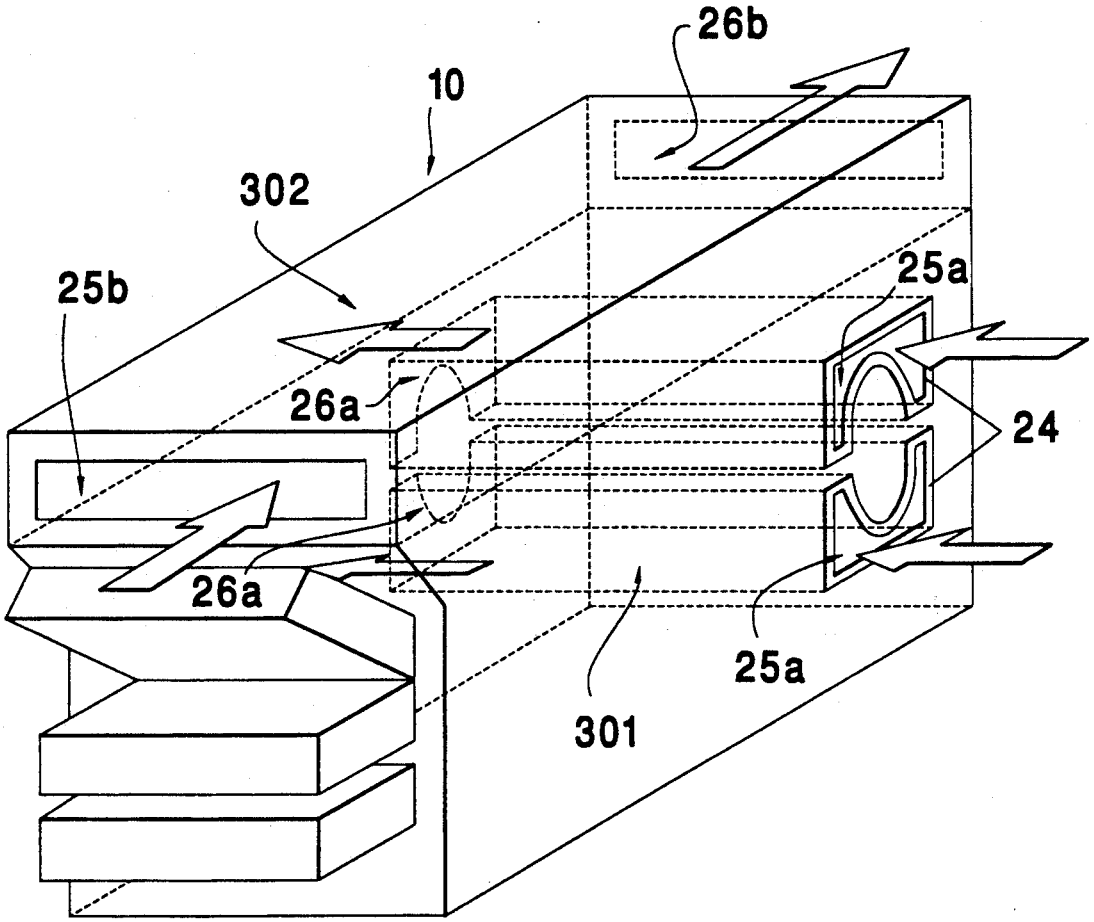
FIG. 5 is a perspective view showing an arrangement of the fixing roller cooling device and optical system cooling device.

FIG. 5 clearly shows the way in which the fixing roller cooling device 30 and optical system cooling device 302 are arranged.

The embodiment shown in FIG. 1 has been put to a recording test in which copies have been taken on 200,000 sheets of recording paper. In the test, measurements were taken of the qualities of dust and ozone contained in the air exhausted through the discharge openings **26*a* associated with the fixing rollers 17**.

For comparison with this embodiment, a similar 200,000-sheet recording test has been conducted on a conventional apparatus which does not separate the cooling air and the air from which the harmful substances are removed. In this test, measurements were taken of quantities of dust and ozone contained in the air exhausted outwardly from a fan provided adjacent fixing rollers.

For measuring the quantity of dust, Particle Counter KC-01A (Brandname) manufactured by Rion Co., Ltd. was used to measure the number of dust particles of 0.3 micrometers and above contained in one cubic feet of air. For measuring the quantity of ozone, Ozone Monitor EG-2001D (Brandname manufactured by Ebara Corp. was used to measure ozone concentration.

These devices were installed in a room environment having a quantity of dust $5 \times 10^4$ and a quantity of ozone 0.03 ppm.

The measurement results are as shown in Table 1 below.

TABLE 1

| | Initial | | After 200,000 copies | |
|---|---|---|---|---|
| | Dust | Ozone (ppm) | Dust | Ozone (ppm) |
| Embodiment | $5 \times 10^4$ | 0.04 | $5 \times 10^4$ | 0.04 |
| Comp. example | $8 \times 10^5$ | 0.05 | $2 \times 10^6$ | 3.2 |

As seen from the above table, the comparative example had a large quantity of dust contained in the exhausted air from the beginning. The quantity of dust increased through the 200,000-sheet copying test. The ozone concentration also was very high when the 200.000-sheet copying test was completed.

By contrast, the embodiment of the present invention had quantities of dust and ozone contained in the exhausted air remained substantially the same as those in the room environment. Thus, the tests showed that the harmful substances such as ozone and dust generated in the housing 10 were not discharged from the housing 10 to the detriment of the room environment.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a housing;

image forming means provided in the housing for forming a toner image onto a sheet;

a fixing station provided in the housing at which the toner image is fixed onto the sheet;

transporting means provided in the housing for transporting the sheet formed with the toner image thereon from the image forming means to the fixing station;

fixing means provided in the fixing station for heating the toner image to be fixed onto the sheet and for transporting the fixed sheet out of the housing, said fixing means extending along a direction perpendicular to the sheet transporting direction by the transporting means;

duct means, separately provided from said fixing means for forming a cooling passageway disposed parallel to and adjacent to the fixing means, said cooling passageway substantially covering the fixing means and having an intake and an outlet provided on an exterior surface of the housing; and drawing means for drawing air into the cooling passageway from the intake to the outlet and for exhausting the drawn air out of the cooling passageway through the outlet to exchange the air radiated from the fixing means with said air drawn into the cooling passageway.

2. An image forming apparatus as claimed in claim 1 wherein the fixing means include:

a pair of pressure members contacting with each other at a contacting area with predetermined pressure, said pressure members extending the direction perpendicular to the sheet transporting direction by the transporting means;

heating means for heating at least one of the pair of pressure members; and carrying means for carrying the sheet to which the toner image is transferred to the contacting area so as to fix the toner image on the sheet.

3. An image forming apparatus as claimed in claim 1 wherein the image forming means include:

an image carrier;

means for forming an electrostatic latent image onto the carrier by applying charges;

developing means for forming the toner image by developing the electrostatic latent image with charged toner particle;

transporting means for transporting a sheet to the carrier; and transferring means for transferring the toner image onto the surface of the sheet.

4. An image forming apparatus as claimed in claim 3 wherein the transferring means include charging means for applying charges onto the surface of the sheet opposite to the surface to which the toner image is transferred, said charges applied by the charging means having the polarity opposite to the polarity of the toner image.

5. An image forming apparatus comprising:

a first housing;

a second housing adjacent to the first housing;

a platen provided on the exterior surface of the first housing for placing a document thereon;

an image carrier having photoconductivity and provided in the second housing;

charging means provided in the second housing for applying charges on the image carrier;

an radiation-light source provided in the first housing for illuminating the platen on which the document is placed;

a transparent partition formed between the first housing and the second housing;

first reflecting means provided in the first housing for reflecting the light of the radiation-light source toward the platen on which the document is placed so as to obtain a light image corresponding to the document and for directing the reflected light to the transparent partition;

second reflecting means provided in the second housing for reflecting the light reflected by the first reflecting means to the image carrier charged by the charging means through the transparent partition so as to form the electrostatic latent image onto the image carrier;

developing means for forming the toner image by developing the electrostatic latent image formed on the carrier with charged toner particle;

an intake provided on the exterior surface of the first housing;

an outlet provided on the exterior surface of the first housing; and drawing means for drawing air into the first housing from the intake and for exhausting the drawn air out of the first housing through the outlet.

6. An image forming apparatus as claimed in claim 5 further including:

transferring means for transferring the toner image from the image carrier to the surface of a sheet by applying charges the surface of the sheet to which the toner image is transferred.

* * * * *